US007681995B2

(12) United States Patent
Kaneko

(10) Patent No.: US 7,681,995 B2
(45) Date of Patent: Mar. 23, 2010

(54) LIQUID EJECTION HEAD AND METHOD OF MANUFACTURING THE SAME

(75) Inventor: Yasuhisa Kaneko, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 496 days.

(21) Appl. No.: 11/194,461

(22) Filed: Aug. 2, 2005

(65) Prior Publication Data

US 2006/0023030 A1 Feb. 2, 2006

(30) Foreign Application Priority Data

Aug. 2, 2004 (JP) ..... 2004-225324

(51) Int. Cl.
*B41J 2/05* (2006.01)

(52) U.S. Cl. ..... 347/65; 347/55; 347/58; 347/54

(58) Field of Classification Search ..... 347/54–56, 347/58, 65, 64, 50; 29/25.35, 890
See application file for complete search history.

(56) References Cited

U.S. PATENT DOCUMENTS 5,144,340 A * 9/1992 Hotomi et al. ..... 347/55
5,835,113 A 11/1998 Hirabara et al.
6,158,844 A * 12/2000 Murakami et al. ..... 347/55
2005/0024439 A1* 2/2005 Fukunaga et al. ..... 347/55

FOREIGN PATENT DOCUMENTS

| | | | |
|---|---|---|---|
| EP | 0 844 088 | A2 | 5/1998 |
| EP | 1 424 204 | A1 | 6/2004 |
| JP | 8-149253 | A | 6/1996 |
| JP | 9-309208 | A | 12/1997 |
| JP | 10-230608 | A | 9/1998 |

* cited by examiner

*Primary Examiner*—Matthew Luu
*Assistant Examiner*—Henok Legesse
(74) *Attorney, Agent, or Firm*—Sughrue Mion, PLLC

(57) ABSTRACT

A liquid ejection head for an electrostatic ink jet including an insulating ejection substrate in which through holes are bored to form ejection openings for ejecting droplets; an insulating support substrate arranged while facing the ejection substrate with a predetermined distance therebetween; a solution flow path provided between the ejection substrate and the support substrate; ejection electrodes, respectively provided corresponding to the through holes, for exerting electrostatic forces on the solution; and a shield electrode, provided corresponding to at least one of the through holes on a solution ejection side with respect to the ejection electrodes, for preventing electric field interferences between the through holes. Plural flow path wall portions contacting the ejection substrate stands in the solution flow path, and at least one of electrode lines connected to the ejection electrodes and electrode lines connected to the shield electrode are contained in the flow path wall portions.

11 Claims, 11 Drawing Sheets

LIQUID EJECTION HEAD AND METHOD OF MANUFACTURING THE SAME

BACKGROUND OF THE INVENTION

The present invention relates to a liquid ejection head for electrostatic ink jet, which ejects droplets by exerting electrostatic forces on a solution in which charged particles are dispersed, and a method of manufacturing the liquid ejection head.

Known examples of liquid ejection heads (hereinafter referred to as the "ejection heads") for ink jet that perform image recording (drawing) by ejecting ink droplets include an ejection head for so-called thermal ink jet that ejects ink droplets by means of expansive forces of bubbles generated in ink through heating of the ink, and an ejection head for so-called piezoelectric-type ink jet that ejects ink droplets by giving pressures to ink using piezoelectric elements.

In the case of the thermal ink jet, however, the ink is partially heated to 300° C. or higher, so there arises a problem in that a material of the ink is limited. On the other hand, in the case of the piezoelectric-type ink jet, there occurs a problem in that a complicated structure is used and an increase in cost is inevitable.

Known as ink jet that solves the problems described above is electrostatic ink jet which uses ink containing charged colorant particles (fine particles), exerts electrostatic forces on the ink, and ejects ink droplets by means of the electrostatic forces.

An ejection head for the electrostatic ink jet includes an insulating ejection substrate, in which many through holes (ejection openings) for ejecting ink droplets are formed, and ejection electrodes that respectively correspond to the ejection openings, and ejects ink droplets by exerting electrostatic forces on ink through application of predetermined voltages to the ejection electrodes. More specifically, with the construction, the ejection head ejects the ink droplets by controlling on/off of the voltage application to the ejection electrodes (modulation-driving the ejection electrodes) in accordance with image data, thereby recording an image corresponding to the image data onto a recording medium.

An example of such an ejection head for the electrostatic ink jet is disclosed in JP 10-230608 A as an ejection head 200. As conceptually shown in FIG. 11, the ejection head 200 includes a support substrate 202, an ink guide 204, an ejection substrate 206, an ejection electrode 208, a bias voltage supply 212, and a drive voltage supply 214.

In the ejection head 200, the support substrate 202 and the ejection substrate 206 are each an insulating substrate and are arranged to be spaced apart from each other by a predetermined distance.

Many through holes (substrate through holes) that each serve as an ejection opening 218 for an ink droplet are formed in the ejection substrate 206, and a gap between the support substrate 202 and the ejection substrate 206 is set as an ink flow path 216 that supplies ink Q to the ejection opening 218. In addition, the ring-shaped ejection electrode 208 is provided to an upper surface (ink-droplet-R-ejection-side surface) of the ejection substrate 206 to surround the ejection opening 218. The bias voltage supply 212 and the drive voltage supply 214 that is a pulse voltage supply are connected to the ejection electrode 208, which is grounded through the voltage supplies 212 and 214.

On the other hand, the ink guide 204 is provided to the support substrate 202, corresponding to each ejection opening 218, and protrudes from the ejection substrate 206 while passing through the ejection opening 218. Also, an ink guide groove 220 for supplying the ink Q to a tip end portion 204*a* of the ink guide 204 is formed by cutting out the tip end portion 204*a* by a predetermined width.

In an (ink jet) recording apparatus disclosed in JP 10-230608 A using the ejection head 200 described above, at the time of image recording, a recording medium P is supported by a counter electrode 210.

The counter electrode 210 functions not only as a counter electrode for the ejection electrode 208 but also as a platen supporting the recording medium P at the time of the image recording and is arranged to face the upper surface of the ejection substrate 206 and to be spaced apart from the tip end portion 204*a* of the ink guide 204 by a predetermined distance.

In the ejection head 200, at the time of the image recording, an ink circulation mechanism (not shown) causes the ink Q containing the charged colorant particles to flow in the ink flow path 216 in a direction, for instance, from the right side to the left side in the drawing. Note that the colorant particles of the ink Q are charged to the same polarity as the voltage applied to the ejection electrode 208.

The recording medium P is supported by the counter electrode 210 and faces the ejection substrate 206.

Further, a DC voltage of, for example, 1.5 kV is constantly applied from the bias voltage supply 212 to the ejection electrode 208 as a bias voltage.

As a result of the ink Q circulation and the bias voltage application, by the action of surface tension of the ink Q, a capillary phenomenon, an electrostatic force due to the bias voltage, and the like, the ink Q is supplied from the ink guide groove 220 to the tip end portion 204*a* of the ink guide 204, a meniscus of the ink Q is formed at the ejection opening 218, the colorant particles move to the vicinity of the ejection opening 218 (migration due to an electrostatic force), and the ink Q is concentrated in the ejection opening 218 and the tip end portion 204*a*.

In this state, when the drive voltage supply 214 applies a pulse-shaped drive voltage of, for example, 500 V corresponding to image data (drive signal) to the ejection electrode 208, the drive voltage is superimposed on the bias voltage and the supply and concentration of the ink Q to and in the tip end portion 204*a* are promoted. When a movement force of the ink Q and the colorant particles to the tip end portion 204*a* and an attraction force from the counter electrode 14 exceed the surface tension of the ink Q, a droplet (ink droplet R) of the ink Q, in which the colorant particles are concentrated, is ejected.

The ejected ink droplet R flies due to momentum at the time of the ejection and the attraction force by the counter electrode 210, impinges on the recording medium P, and forms an image.

In addition, JP 08-149253 A discloses an electrostatic ink jet recording apparatus which includes an electrode array formed on a surface of a substrate, a supply device that supplies ink onto the electrode array, and a voltage application device that applies drive voltages to the electrode array. Further, JP 09-309208 A discloses an electrostatic ink jet recording apparatus which includes an ink supply path having many openings formed to a surface of an insulating base material and serving as nozzles, electrodes formed on the surface of the base material to surround the openings, and a supply device that supplies ink to the openings from the inside of the base material through the ink supply path.

In recent years, an increase in recording density for supporting a high resolution and an increase in speed are demanded of even such an electrostatic ink jet head (electrostatic ink jet recording apparatus).

In order to achieve the increase in recording density, it is required to form the ink ejection portions, that is, the ejection openings and the ejection electrodes (as well as the ink guides in some cases) on the substrate at a high density (it is required to increase a packaging density). In addition, two-dimensional arrangement of the ejection portions is also extremely effective for the increase in recording density and the increase in speed.

As is apparent also from the construction in each patent document described above, however, when the density of the ejection portions is increased, wiring for applying drive voltages to the respective ejection electrodes at the ejection substrate becomes complicated and increases in density and multilayering of the wiring is also required in some cases. In addition, when the ejection portions are arranged in a two-dimensional manner, the multilayering of the wiring becomes indispensable to some extent in terms of the construction.

As a result, the electrostatic ink jet ejection head has a problem in that as its recording density is increased, its structure becomes complicated. In addition, when the multilayering is achieved while maintaining ejection performance, the thickness of a wiring substrate is limited for stabilized ink supply to the ejection portions and maintenance of an inter-counter-electrode distance. Therefore, for the multilayering, it is required to reduce a distance between wires on a wiring side or reduce the thickness of an insulation layer. However, this results in a problem in that a withstand voltage is reduced.

In addition, when the ejection portions are arranged at a high density or in a two-dimensional manner, as a matter of course, distances between adjacent ejection portions are reduced, so electric field interferences occur between the adjacent ejection portions. As a result, there also occurs a problem in that, for instance, ejection becomes unstable and ejection at high speed (high recording (droplet ejection) frequency) becomes impossible.

SUMMARY OF THE INVENTION

The present invention has been made in order to solve the problems of the conventional techniques described above, and therefore has an object to provide a liquid ejection head for electrostatic ink jet, with which even when ejection portions (ejection holes and ejection electrodes (as well as ink guides in some cases)) are formed at a high density (high packaging density) in order to enable image recording at a high recording density, it becomes possible to perform wiring for supplying drive voltages to the ejection electrodes with ease by eliminating a necessity for multilayering of the wiring, and it also becomes possible to perform high-speed ejection with stability by preventing electric field interferences (inter-channel electric field interferences) between adjacent ejection portions. Also, the present invention has an object to provide a manufacturing method with which it becomes possible to manufacture the liquid ejection head with high accuracy and at low cost.

The invention provides a liquid ejection head for ejecting droplets of a solution, in which charged particles are dispersed, by exerting electrostatic forces on the solution, comprising:

an insulating ejection substrate in which through holes are bored to form ejection openings for ejecting the droplets;

an insulating support substrate arranged while facing the ejection substrate with a predetermined distance therebetween;

a solution flow path provided between the ejection substrate and the support substrate; ejection electrodes respectively corresponding to the through holes, for exerting the electrostatic forces on the solution; and a shield electrode corresponding to at least one of the through holes on a solution ejection side with respect to the ejection electrodes, for preventing electric field interferences between the through holes, wherein flow path wall portions contacting the ejection substrate are formed in the solution flow path, and at least one of electrode lines connected to the ejection electrodes and electrode lines connected to the shield electrode are contained in the flow path wall portions.

In the liquid ejection head, it is preferable that solution guides are provided while standing from the support substrate, respectively corresponding to the through holes and protruding to a droplet ejection side of the ejection substrate by passing through the through holes are provided while standing from the support substrate.

Preferably, the ejection electrodes are formed on a substrate surface on a solution flow path side of the ejection substrate and the flow path wall portions are joined to both the ejection substrate and the support substrate; and the ejection electrodes are connected to the electrode lines, the electrode lines passing through the support substrate via the flow path wall portions and extending to an underside of the support substrate on a side opposite to the solution flow path, on which side connection terminals for connection to external voltage supply units are provided.

Alternatively, the ejection electrodes are preferably formed on a substrate surface on a solution flow path side of the ejection substrate and the flow path wall portions are joined to both the ejection substrate and the support substrate; and the ejection electrodes are preferably connected to the electrode lines, the electrode lines extending from the support substrate to a side surface of the support substrate via the flow path wall portions and being connected to external voltage supply units from the side surface.

The shield electrode is preferably formed on a substrate surface on a side opposite to the solution flow path of the ejection substrate, the flow path wall portions contain the electrode lines connected to the ejection electrodes and the electrode lines connected to the shield electrode, and the electrode lines connected to the shield electrode pass through the ejection substrate and extend to a substrate surface side of the ejection substrate on which the shield electrode is formed.

Also preferably, the shield electrode is provided to a substrate surface on a side opposite to the solution flow path of the ejection substrate, and the ejection electrodes are provided to a substrate surface on a side facing the solution flow path of the ejection substrate.

It is preferable that one flow path wall portion is formed for a group of the through holes and at least one of the electrode lines of the ejection electrodes, and the electrode lines of the shield electrode corresponding to the through holes in the group are contained in the flow path wall portion.

A surface of the shield electrode may be given ink repellency.

The shield electrode is preferably formed of a conductor layer on the ejection substrate to surround peripheries of ejection openings of the through holes, and vertical barriers that separate meniscuses of the solution formed in the vicinity of the ejection openings from each other are provided to an upper surface of the conductor layer forming the shield electrode.

Preferably, the through holes formed in the ejection substrate form rows along a solution flow direction in the solution flow path, the flow path wall portions provided in the solution flow path are formed along the rows of the through holes, and the electrode lines corresponding to the rows of the through holes are contained in the flow path wall portions.

The invention also provides a method of manufacturing a liquid ejection head for ejecting droplets of a solution, in which charged particles are dispersed, by exerting electrostatic forces on the solution, comprising:

producing a first substrate member that includes through holes for ejecting the droplets, ejection electrodes respectively corresponding to the through holes, for exerting the electrostatic forces on the solution, and a shield electrode corresponding to at least one of the through holes on a solution ejection side with respect to the ejection electrodes, for preventing electric field interferences between the through holes, the first substrate member serving as an insulating ejection substrate;

producing a second substrate member that includes solution guides standing from a substrate surface, for guiding the solution to a tip end side and flow path wall portions standing from the surface and containing electrode lines for connection to the ejection electrodes, the second substrate member serving as an insulating support substrate; and joining, at a time of assembling the first substrate member and the second substrate member with a predetermined distance therebetween, the flow path wall portions and the first substrate member to each other by providing connection substrate members for connecting the electrode lines of the flow path wall portions and the ejection electrodes to each other and aligning the first substrate member and the second substrate member with each other.

The aligning of the first substrate member and the second substrate member with each other is preferably performed using a flip chip bonder.

The invention also provides a method of manufacturing a liquid ejection head for ejecting droplets of a solution, in which charged particles are dispersed, by exerting electrostatic forces on the solution, comprising:

producing a first substrate member that includes through holes for ejecting the droplets, ejection electrodes respectively corresponding to the through holes, for exerting the electrostatic forces on the solution, a shield electrode corresponding to at least one of the through holes on a solution ejection side with respect to the ejection electrodes, for preventing electric field interferences between the through holes, and flow path wall portions standing from a substrate surface and containing electrode lines connected to the ejection electrodes, the first substrate member serving as an insulating ejection substrate;

producing a second substrate member that includes solution guides standing from a substrate surface, for guiding the solution to a tip end side and connection terminals for connecting the ejection electrodes and external voltage supply units to each other, the second substrate member serving as an insulating support substrate; and joining, at a time of assembling the first substrate member and the second substrate member with a predetermined distance therebetween, the flow path wall portions and the second substrate member to each other by providing connection substrate members for connecting the electrode lines of the flow path wall portions and the connection terminals to each other and aligning the first substrate member and the second substrate member with each other.

The aligning of the first substrate member and the second substrate member with each other is preferably performed using a flip chip bonder.

The liquid ejection head according to the present invention having the construction described above is a liquid ejection head for electrostatic ink jet that includes an ejection substrate having ink ejection holes and a support substrate spaced apart from the ejection substrate by a predetermined distance, with a gap between the substrates being set as an ink flow path for supplying ink to the ejection holes, where flow path wall portions that contact at least the ejection substrate are provided to the ink flow path and electrode lines connected to ejection electrodes and electrode lines connected to a shield electrode for prevention of electric field interferences between ejection portions are drawn through the flow path wall portions.

Accordingly, by drawing the electrode lines connected to the ejection electrodes, that is, wiring of the ejection electrodes through the flow path wall portions, it becomes possible to establish connection from the underside or a side surface of the support substrate to an external voltage supply through simple wiring while preventing complication of the wiring and multilayering of the wiring. Accordingly, even in the case of a high recording density, it becomes possible to simplify the construction of the liquid ejection head and it also becomes possible to prevent drop in withstand voltage resulting from the multilayering of the wiring.

When the electrode lines connected to the shield electrode are drawn through the flow path wall portions, it becomes possible to suppress the electric field interferences between the adjacent ejection portions even in the flow path, thereby making it possible to further stabilize ejection of ink droplets and also to suitably support high-speed ejection (high recording frequency).

Further, with the liquid ejection head manufacturing method according to the present invention having the construction described above, it becomes possible to perform alignment between the electrode lines and the ejection electrodes or alignment between the electrode lines and connection terminals for connection to an external voltage supply in the same manner as self-alignment in so-called flip chip bonding, thereby making it possible to manufacture the liquid ejection head according to the present invention having the superior characteristics described above with high accuracy while achieving high productivity at low cost by simplifying the alignment between the ejection substrate and the support substrate.

DETAILED DESCRIPTION OF THE PREFERRED EMBODIMENTS

Hereinafter, a liquid ejection head and a liquid ejection head manufacturing method according to the present invention will be described in detail based on a preferred embodiment illustrated in the accompanying drawings.

Figure 1A:
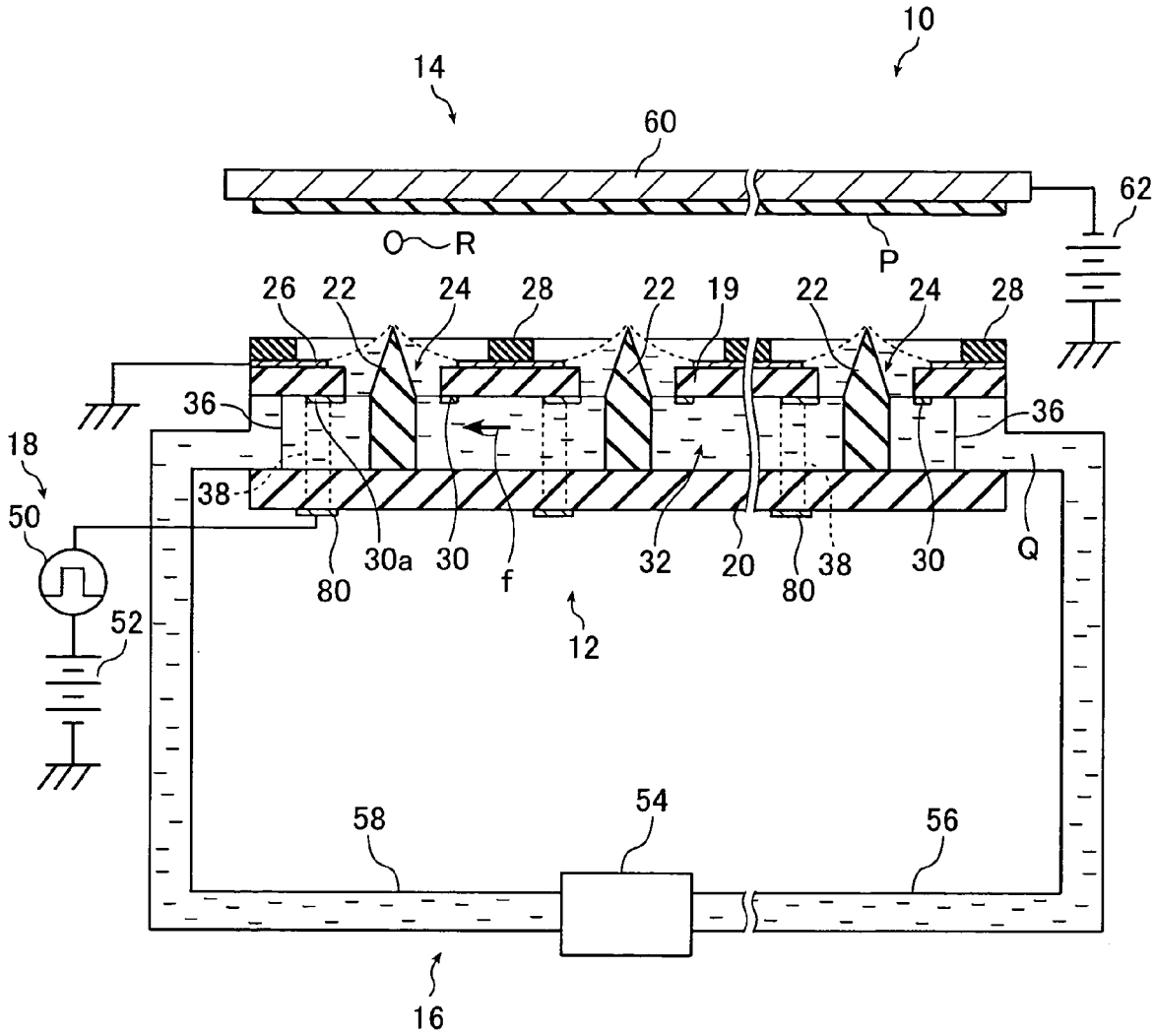
FIG. 1A is a conceptual diagram of an example of an ink jet recording apparatus that uses an example of the liquid ejection head according to the present invention.
Figure 1B:
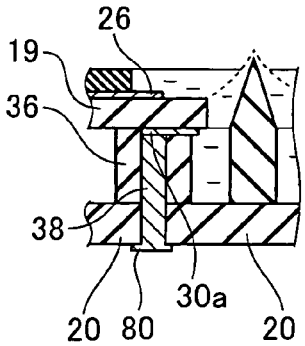
FIG. 1B is a partial diagram of the liquid ejection head shown in FIG. 1A.

FIGS. 1A and 1B are each a conceptual diagram of an example of an ink jet recording apparatus that uses an example of the liquid ejection head for electrostatic ink jet according to the present invention. Note that FIG. 1A is a cross-sectional view taken along line a in FIG. 3, while FIG. 1B is a cross-sectional view taken along line b in FIG. 3 for clearer construction illustration.

An ink jet recording apparatus 10 (hereinafter referred to as the "recording apparatus 10") shown in FIG. 1 performs image recording (drawing) on a recording medium P by ejecting ink droplets R through electrostatic ink jet and basically includes a liquid ejection head 12 (hereinafter referred to as the "ejection head 12") according to the present invention, a holding portion 14 for holding the recording medium P, an ink circulation system 16, and a voltage application unit 18.

It should be noted here that as ink Q that is ejected by the ejection head 12 according to the present invention, it is possible to use various kinds of ink Q (solutions) used for electrostatic ink jet such as ink in which charged particles (hereinafter referred to as the "colorant particles") containing colorant components, a charge control agent, a binder, and the like are dispersed and floated in a colloid manner in an insulating dispersion medium having a resistivity of $10^8$ Ω or more.

In the recording apparatus 10 in the illustrated example, the ejection head 12 is, for instance, a so-called line head including rows (hereinafter referred to as the "nozzle rows") of openings 24 for ejecting the ink droplets R whose length corresponds to the length on one side of the rectangular recording medium P.

In the recording apparatus 10, the recording medium P is held by the holding portion 14, and the holding portion 14 is moved (scan-transported) in a direction orthogonal to the nozzle rows of the ejection head 12 in a state where the recording medium P is located in a predetermined recording position and faces the ejection head 12, thereby allowing two-dimensional scanning of the entire surface of the recording medium P with the nozzle rows. In synchronization with the scanning, modulation is performed in accordance with an image to be recorded and the ink droplet R is ejected from each ejection opening 24 of the ejection head 12, thereby allowing recording of the image on the recording medium P in an on-demand manner.

Also, at the time of the image recording, the ink Q is circulated by the ink circulation system 16 through a predetermined circulation path including the ejection head 12 (ink flow path 32 to be described later) and is supplied to each ejection opening 24.

Figure 2:
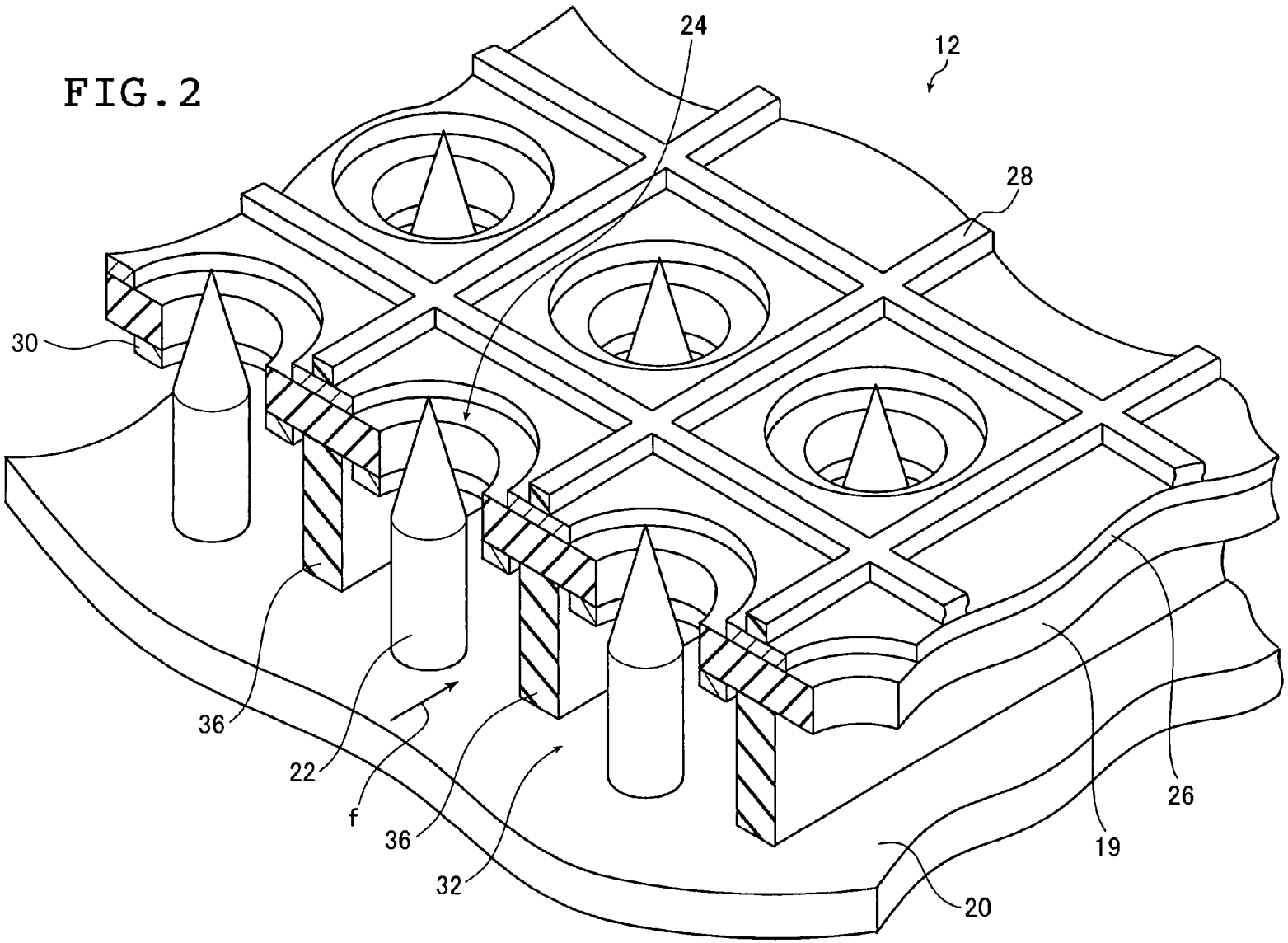
FIG. 2 is a schematic perspective view of the liquid ejection head shown in FIGS. 1A and 1B.

The ejection head 12 is a liquid ejection head for electrostatic ink jet that ejects the ink Q (ink droplets R) by means of electrostatic forces and basically includes an ejection substrate 19, a support substrate 20, and ink guides 22 as shown in FIGS. 1A and 2. Also, between the ejection substrate 19 and the support substrate 20, flow path wall portions 36 are formed which exist while extending in an ink flow direction (direction of arrow f in the drawings) and contact both of the substrates.

The ejection substrate 19 is a substrate made of a ceramics material, such as $Al_2O_3$ or $ZrO_2$, or an insulating material, such as polyimide, and many ejection openings 24 are established for ejecting the ink droplets R of the ink Q passing through the ejection substrate 19.

Figure 3:
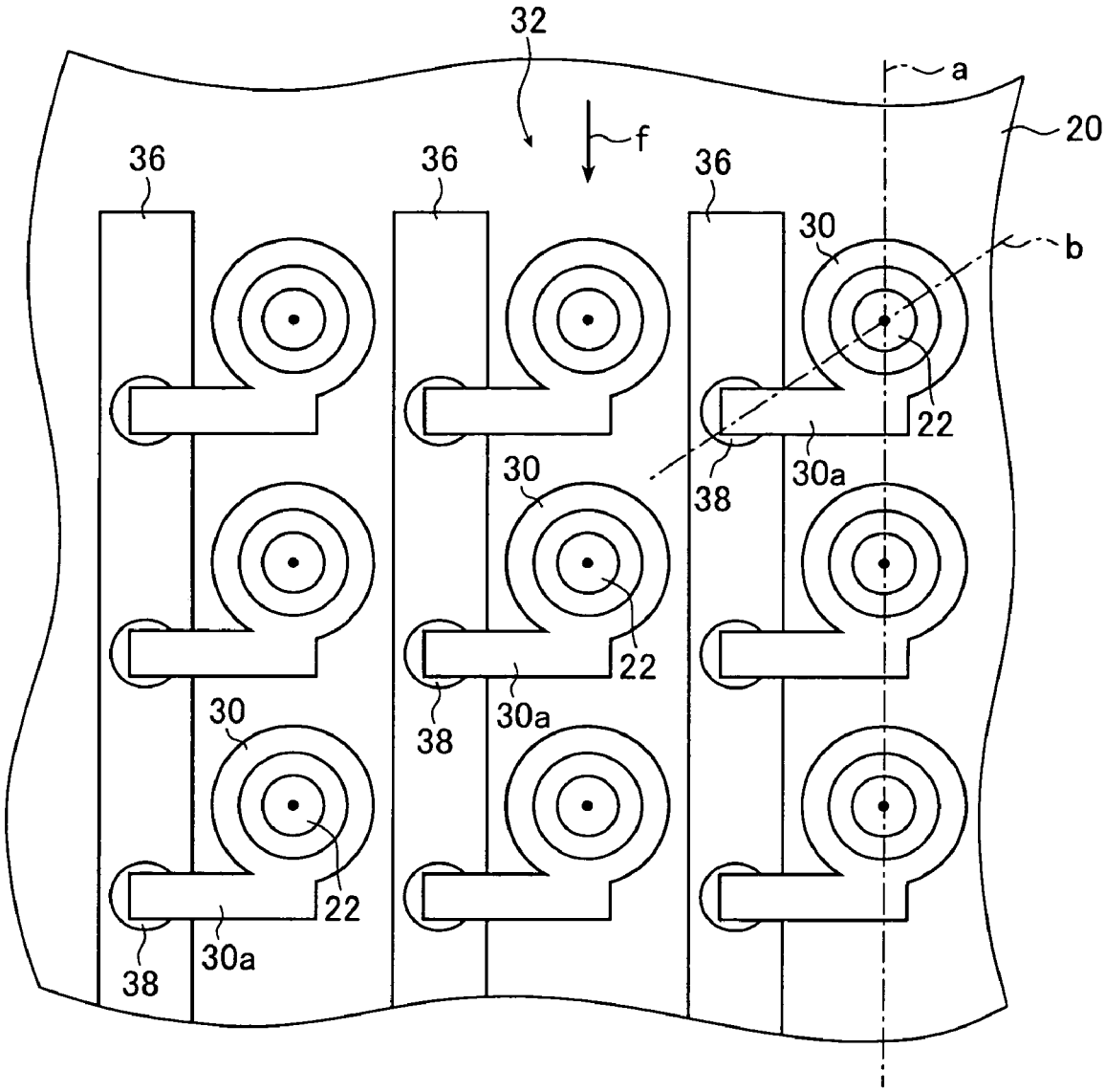
FIG. 3 is a conceptual top view of the liquid ejection head shown in FIGS. 1A and 1B.

As shown in a schematic perspective view of FIG. 2 and a top view of FIG. 3 in which the ejection substrate 19 is removed (from above ejection electrodes 30), as a preferable example in which higher-resolution and higher-speed image recording is possible, the ejection head 12 includes the ejection openings 24 arranged in a two-dimensional lattice manner.

It should be noted here that the liquid ejection head according to the present invention is not limited to the construction in the illustrated example, in which the ejection openings 24 are arranged in a lattice manner, and may have a construction in which adjacent nozzle rows are displaced from each other by a half pitch and the ejection openings are arranged in a staggered lattice manner, for instance. Alternatively, the liquid ejection head according to the present invention may have a construction in which the ejection openings are not arranged in a two-dimensional manner but only one nozzle row is included.

Also, the present invention is not limited to the line head in the illustrated example and may be applied to a so-called shuttle-type liquid ejection head that performs drawing by transporting the recording medium P in the nozzle row direction intermittently every predetermined length corresponding to the length of the nozzle row and moving the liquid ejection head in a direction orthogonal to the nozzle row relative to the recording medium P in synchronization with the intermittent transportation.

Further, the liquid ejection head according to the present invention may be an ejection head that ejects only one kind of ink corresponding to monochrome image recording or a liquid ejection head that ejects multiple kinds of ink corresponding to color image recording.

As a preferable form, a region of the upper surface (droplet-ejection-side=recording-medium-P-side surface, hereinafter a droplet-ejection-side direction (=recording-medium-P-side direction) will be referred to as the "upward direction" and the opposite direction will be referred to as the "downward direction") of the ejection substrate 19 except regions of the ejection openings 24 and regions above the ejection electrodes 30 is covered with a shield electrode 26 substantially in its entirety.

The shield electrode 26 is a sheet-shaped electrode made of a conductive metallic plate or the like and common to every ejection opening 24 and is held at a predetermined potential (including 0 V through grounding). In the illustrated example, as shown in FIG. 1A, the shield electrode 26 is held at 0 V through grounding. With the shield electrode 26, it becomes possible to stabilize the ejection of the ink droplets R by shielding electric flux at the ejection openings 24 (ejection portions) adjacent to each other and preventing electric field interferences between the ejection portions.

Also, as necessary, a surface of the shield electrode 26 may be subjected to ink repellency giving processing.

As a preferable form, vertical barriers 28 are arranged for the upper surface of the shield electrode 26.

The vertical barriers 28 surround the respective ejection openings 24 to separate the ejection openings from each other, thereby preventing linkage of the ink Q between adjacent ejection openings 24 and achieving reliable separation of the meniscuses of the ink Q at the ejection openings 24 (ejection portions) from each other.

In the illustrated example, as shown in FIG. 2, the vertical barriers 28 are formed as lattice walls that separate the ejection openings 24 from each other. However, the present invention is not limited thereto, and so long as it is possible to separate the ejection openings 24 from each other, other vertical barriers may be used, an example of which is cylindrical vertical barriers that each surround one ejection opening 24.

Also, in order to prevent the ink from climbing the wall surfaces of the vertical barriers 28 with reliability and prevent linkage of the ink Q between the ejection openings 24 with reliability, it is preferable to give ink repellency to the surfaces of the vertical barriers 28 through ink repellency giving processing or the like. Note that it is sufficient that the ink repellent processing of the shield electrode 26 and the vertical barriers 28 is performed with a known method according to each material of the dispersion medium of the ink Q, and the like.

For the lower surface of the ejection substrate 19, ejection electrodes 30 are provided to respectively correspond to the ejection openings 24.

In the illustrated example, the ejection electrodes 30 are each a ring-shaped electrode surrounding one ejection opening 24, and connection portions 30*a* for connection to electrode lines 38 to be described later are formed.

It should be noted here that in the present invention, the ejection electrodes 30 are not limited to the ring shape in the illustrated example and may have a rectangular shape surrounding the ejection openings 24. Also, the ejection electrodes 30 are not limited to the shapes surrounding the whole regions of the ejection openings 24 and it is also possible to suitably use ejection electrodes in a shape, such as an approximately C-letter shape, in which electrodes surrounding the ejection openings 24 are partially removed.

Also, in the case of the shape, such as the C-letter shape, in which the ejection electrodes are partially removed, it is preferable to remove the electrodes on their upstream side with respect to the ink flow direction of the ink flow path 32. With such a construction in which the ejection electrodes are partially removed on the upstream side, it becomes possible to reduce repulsive forces exerted on the charged particles in the ink due to electrostatic forces at the time of application of drive voltages to the ejection electrodes, which makes it possible to efficiently perform the migration of the colorant particles to the meniscuses (ink guides 22) to be described later (concentration of the ink).

The support substrate 20 is also a substrate made of an insulating material such as glass.

The ejection substrate 19 and the support substrate 20 are arranged to be spaced apart from each other by a predetermined distance, and a gap therebetween is set as the ink flow path 32 that supplies the ink Q to each ejection opening 24.

The ink flow path 32 is connected to the ink circulation system 16 to be described later, and as a result of circulation of the ink Q through a predetermined path by the ink circulation system 16, the ink Q flows through the ink flow path 32 (in the direction of arrow f in the drawing) and is supplied to each ejection opening 24.

The ink guides 22 are provided on the upper surface of the support substrate 20.

The ink guides 22 are each a member for facilitating the ejection of the ink droplet R by guiding the ink Q supplied from the ink flow path 32 to the ejection opening 24, stabilizing a meniscus through adjustment of the shape and size of the meniscus, and increasing an electrostatic force through concentration of an electric field on the meniscus through concentration of the electric field on itself, and are respectively arranged for the ejection openings 24 so as to protrude from the surface of the ejection substrate 19 to the recording-medium-P (holding-means-14) side while passing through the ejection openings 24.

By each set of one ejection opening 24, one ejection electrode 30, and one ink guide 22 corresponding to one another, one ejection portion (one channel) corresponding to one dot droplet ejection is formed, with the tip end portion of the ink guide 22 serving as a flying position of the ink.

In the ejection head 12 in the illustrated example, for instance, the ink guides 22 each have a shape including a lower (base-portion-side) cylindrical portion and an upper (tip-end-portion-side) conical portion whose centers coincide with that of the ejection electrode 30. The maximum diameter portions of the ink guides 22 are set slightly smaller than the inner diameter of the ejection electrodes 30. Also, for concentration of electric fields, a metal may be evaporated onto the tip end portions of the ink guides 22.

The sizes of the ejection electrodes 30 and the ink guides 22 are not specifically limited and may be set as appropriate in accordance with a recording density, the size of the ejection holes, the kind of the ink, and the like. Here, it is preferable that a ratio between the inner diameter of the ejection electrodes 30 and a distance from the surface of the ejection electrodes 30 to the tip ends of the ink guides 22 be set in a range of 1:0.5 to 1:2, in particular, a range of 1:0.7 to 1:1.7. That is, when the inner diameter of the ejection electrodes 30 is referred to as "r" and the distance from the ejection electrode surfaces to the ink guide tip ends is referred to as "h", it is preferable that the ejection electrode inner diameter and/or the distance from the ejection electrode surfaces to the ink guide tip ends be set to obtain a ratio of "h/r" being 0.5 to 2, in particular, 0.7 to 1.7.

By setting the ratio in the range, it becomes possible to cause the electric fields formed by the ejection electrodes 30 to suitably converge to the ink guides 22 and form strong electric fields, which makes it possible to eject ink droplets with reliability even when the drive voltages applied to the ejection electrodes 30 are reduced.

Also, in the present invention, the ink guides are not limited to the shape in the illustrated example and various shapes are usable. For instance, a conical shape may be used which does not include the lower cylindrical portion in the illustrated example, a pyramidal shape may be used examples of which are a quadrilateral pyramidal shape and a hexagonal pyramidal shape, and a shape may be used which includes a lower prismatic portion and an upper pyramidal portion. Also, a shape may be used which, like the ink guide disclosed in JP 10-230608 A, includes a cutout portion, a groove, or the like that guides the ink to the tip end portion or the like.

Further, the ink guides are not limited to the shapes that are gradually narrowed toward the tip end portions and may have a shape, such as a columnar shape or a prismatic shape, whose thickness is uniform.

However, when consideration is given to electric field concentration at the tip end portions of the ink guides, that is, the meniscus tip end portions, a shape is preferable in which at least the upper portions are gradually narrowed toward the tip ends, and a shape, such as a conical shape or a pyramidal shape, in which the tip end portions are sharply pointed is particularly preferable. Also, when the tip end portions of the ink guides are narrowed, the shape of the rising portions of the meniscuses formed at the tip end portions is narrowed, so it advantageously becomes possible to improve ejectability and reduce the size of the ink droplets R.

As shown in FIGS. 1A, 1B, and 2 as well as FIG. 3 that is a top view in which the ejection substrate 19 is removed from above the ejection electrodes 30, in the ejection head 12 in the illustrated example, the flow path wall portions 36 are formed in the ink flow path 32. The portion 36 respectively correspond to the rows of the ejection portions (mutually corresponding ejection openings 24, ejection electrodes 30, and ink guides 22) in the ink flow direction (direction of arrow f in the drawing) and extend in the ink flow direction so that they connect the ejection substrate 19 and the support substrate 20 to each other. Note that it is sufficient that the flow path wall portions 36 are made of an insulating material that is the same as the insulating material of the support substrate 20.

Also, in the flow path wall portions 36, the electrode lines 38 respectively connected to the ejection electrodes 30 (their connection portions 30*a*) are arranged to pass through the flow path wall portions 36 vertically (from the ejection substrate 19 to the support substrate 20). The electrode lines 38 pass through the support substrate 20, reach the underside of the substrate 20, and are connected to corresponding voltage application units 18 via connection portions (connection terminals) 80 (see FIG. 1B, note that only the voltage application unit for the leftmost ejection portion in the drawing is shown).

The voltage application unit 18 is a unit in which a drive voltage supply 50 and a bias voltage supply 52 are connected to each other in series, with a polarity side (positive-polarity side, for instance) having the same polarity as the colorant particles of the ink Q being connected to the ejection electrodes 30 and the other polarity side being grounded.

The drive voltage supply 50 is, for instance, a pulse voltage supply and supplies pulse-shaped drive voltages modulated in accordance with an image to be recorded (image data=ejection signal) to the ejection electrodes 30. The bias voltage supply 52 constantly applies a predetermined bias voltage to the ejection electrodes 30 during image recording. Through the bias voltage application by the bias voltage supply 52, it becomes possible to achieve a reduction in drive voltage, which makes it possible to achieve a reduction in voltage consumption and a cost reduction of the drive voltage supply.

In the ejection head 10 in the illustrated example, by forming the flow path wall portions 36 containing the electrode lines 38 in the ink flow path 32, connecting them to the ejection electrodes 30, and arranging the electrode lines 38 passing through to the underside of the support substrate 20 and respectively corresponding to the ejection electrodes 30 in the flow path wall portions 36 (the flow path wall portions 36 contain the electrode lines 38) in the manner described above, even when the ejection head for electrostatic ink jet has the two-dimensional arrangement of the ejection openings 24 (ejection portions) in the illustrated example, it becomes possible to simplify the wiring for supplying the drive voltages to the ejection electrodes and significantly simplify the construction of the ejection head 12.

Figure 11:
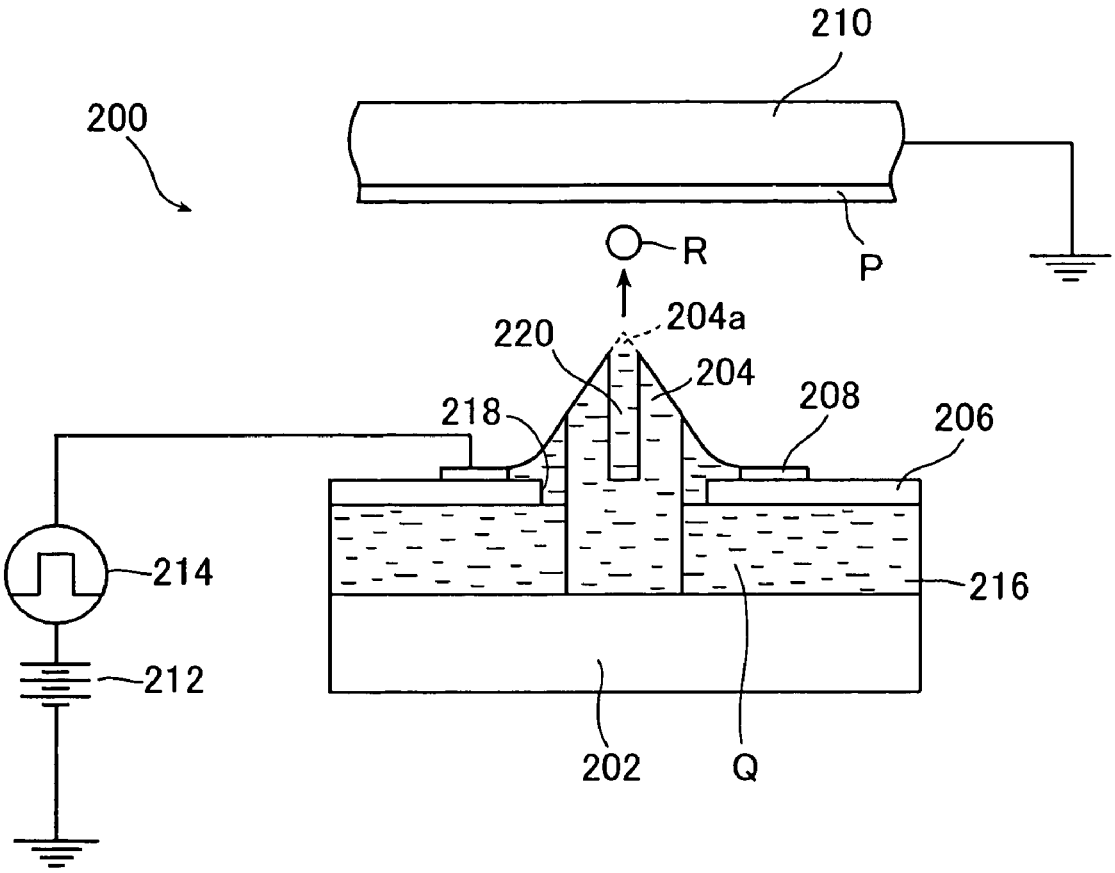
FIG. 11 PRIOR ART
FIG. 11 is a conceptual diagram for explanation of an example of a conventional liquid ejection head.

Like in the example disclosed in JP 10-230608 A shown in FIG. 11, in an ordinary liquid ejection head for electrostatic ink jet, ejection electrodes are formed on the upper surface or underside of an ejection substrate in which ejection openings are formed. Therefore, it is required to set wiring for supplying drive voltages to the ejection electrodes in the ejection substrate and when the ejection portions are arranged at a high density for an increase in resolution or the like, the wiring becomes complicated and multilayering of the wiring becomes necessary in some cases. In particular, when the ejection portions are formed in a two-dimensional manner, the multilayering of the wiring is indispensable. Therefore, in the conventional electrostatic ink jet, the design of the liquid ejection head becomes difficult and the construction thereof becomes extremely complicated.

In contrast, in the ejection head 10 according to the present invention, the flow path wall portions 36 are formed in the ink flow path 32 and the electrode lines 38 connected to the ejection electrodes 30 are contained in the flow path wall portions 36. Therefore, it becomes possible to establish connection between each ejection electrode 30 and a corresponding voltage application unit 18 (drive voltage supply 50 and bias voltage supply 52) from the underside of the support substrate 20, that is, the underside of the ejection head 12, which significantly simplifies the wiring to the ejection electrodes 30. As a result, it becomes possible to simplify the design of the ejection head and also simplify the construction thereof.

The ejection head 10 in the illustrated example has one flow path wall portion 36 for each row of ejection portions in the ink flow direction, but the present invention is not limited thereto.

For instance, instead of the construction in the illustrated example in which each flow path wall portion 36 corresponds to the whole ejection portions in one row in the ink flow direction, a construction may be used in which each flow path wall portion extending in the ink flow direction is formed to correspond to a part of one row of ejection portions in the ink flow direction. Also, one flow path wall portion may be formed for each ejection portion, and the electrode line 38 connected to a corresponding ejection electrode 30 (or an electrode line connected to the shield electrode 26 to be described later) may be contained in the flow path wall portion. Further, one flow path wall portion may be formed for each appropriately set group of multiple ejection portions and the electrode lines 38 connected to corresponding ejection electrodes 30 (same as before) may be contained in the flow path wall portion.

Figure 4:
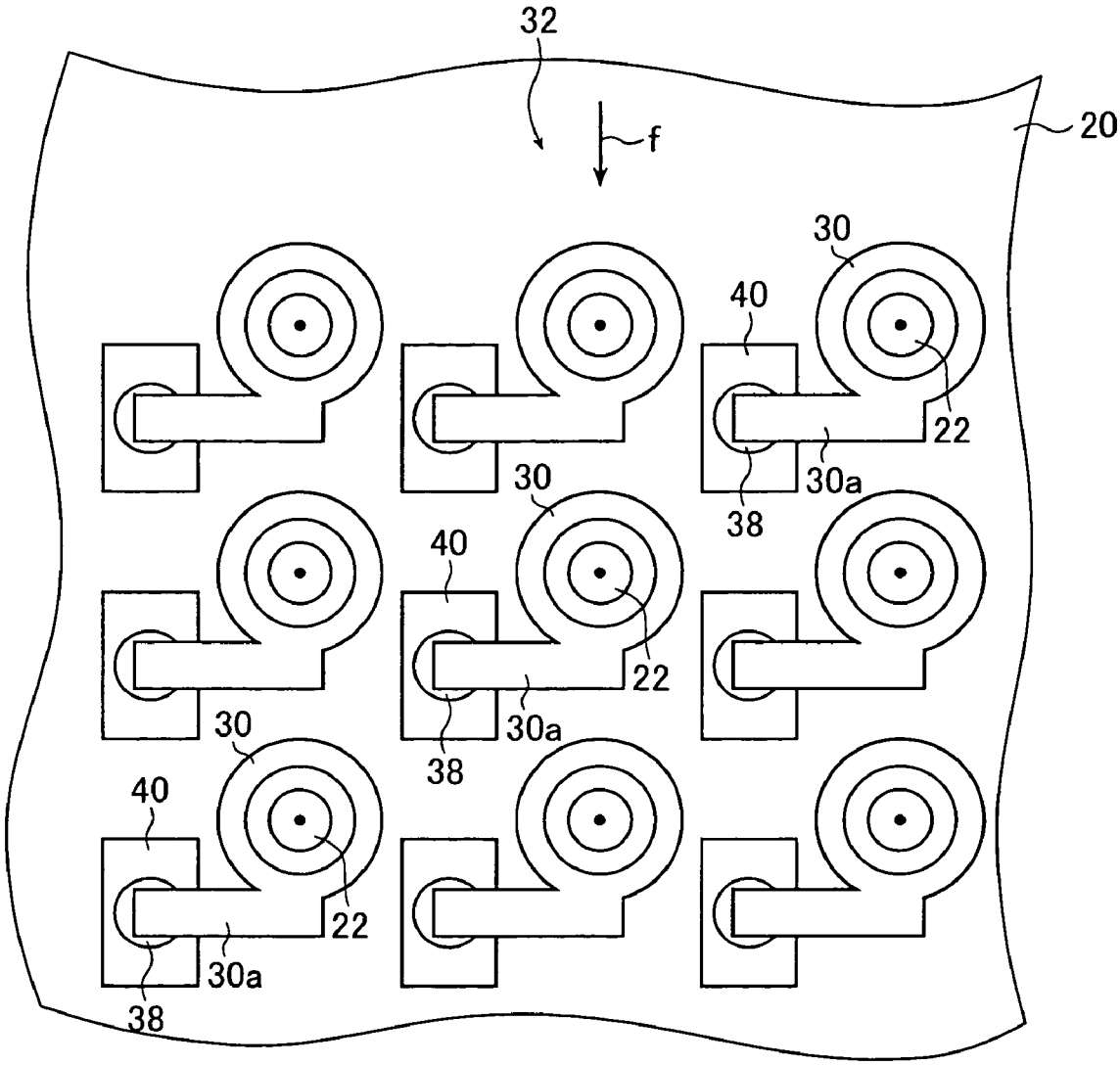
FIG. 4 is a conceptual top view of another example of the liquid ejection head according to the present invention.

Also, as shown in FIG. 4 (top view in which the ejection substrate is removed like in FIG. 3), one flow path wall portion 40 may be provided for each ejection portion, and an electrode line 38 may be contained in the flow path wall portion and connected to a corresponding ejection electrode 30 (connection portion 30*a*). Note that the construction shown in FIG. 4 is advantageous in terms of supplying the colorant particles to each ejection opening 24.

In addition, a construction may be used in which flow path wall portions, which respectively contain electrode lines corresponding to the number of ejection portions at the (approximately) center position or the like of multiple ejection portions whose number is appropriately determined to four, six, eight, or the like, are formed and establish connection to ejection electrodes of corresponding ejection portions.

It should be noted here that in any construction including each form to be described later, it is preferable that in a possible variety of the constructions, the electrode lines 38 connected to the ejection electrodes 30 be arranged on a downstream side in the ink flow direction with respect to the ink guides 22 of corresponding ejection portions, as shown in FIGS. 1A and 1B as well as 3. With this construction, it becomes possible to prevent electrostatic forces formed by the electrode lines from acting on the ink guides 22 and stabilize the concentration of the colorant particles in the ejection portions.

Also, in the illustrated example, as a preferable example in which superior productivity is achieved and simple wiring is possible, the connection between the electrode lines 38 and the voltage application units 18 is established on the underside of the support substrate 20, but the present invention is not limited thereto. For instance, the connection between the electrode lines 38 and the voltage application units 18 may be established on a side surface (side edge portion) of the support substrate 20. Also, a construction may be used in which both the connection on the underside of the support substrate 20 and the connection on the side surface thereof are established.

As described above, the ink is supplied by the ink circulation system 16 to the ink flow path 32 formed between the ejection substrate 19 and the support substrate 20.

The ink circulation system 16 includes an ink supply unit 54 having an ink tank reserving the ink Q and a pump supplying the ink Q, an ink supply flow path 56 that connects the ink supply unit 54 and an ink inflow opening of the ink flow path 32 (right-side end portion of the ink flow path 32 in FIG. 1) to each other, and an ink recovery flow path 58 that connects an ink outflow opening of the ink flow path 32 (left-side end portion of the ink flow path 32 in FIG. 1) and the ink supply unit 54 to each other. Also, in addition to these construction elements, the ink circulation system 16 may include a unit for replenishing the ink and the like.

The ink Q is circulated through a path in which the ink Q is supplied from the ink supply unit 54 to the ink flow path 32 of the ejection head 12 through the ink supply flow path 56, flows through the ink flow path 32 (in the direction of arrow f in the drawing), and returns from the ink flow path 32 to the ink supply unit 54 through the ink recovery flow path 58. During the ink circulation, the ink is supplied from the ink flow path 32 to each ejection portion.

As described above, the holding portion 14 holds the recording medium P and scan-transports it in a direction (hereinafter referred to as the "scanning direction") orthogonal to the nozzle row direction of the ejection head 12.

In the illustrated example, the holding portion 14 includes a counter electrode 60 that also functions as a platen that holds the recording medium P in a state where the medium P faces the upper surface of the ejection head 12 (ejection substrate 19), a counter bias voltage supply 62, and a scan-transport unit (not shown) for scan-transporting the recording medium P in the scanning direction by moving the counter electrode 60 in the scanning direction. As a result of the scan-transport, the recording medium P is two-dimensionally scanned in its entirety by the ejection openings 24 (nozzle rows) of the ejection head 12, and an image is recorded by the ink droplets R modulated and ejected from the respective ejection openings 24.

No specific limitation is imposed on the holding portion which holds recording medium P by the counter electrode 60 and it is sufficient that a known method, such as a method utilizing static electricity, a method using a jig, or a method by suction, is used.

Also, no specific limitation is imposed on a method of moving the counter electrode 60 and it is sufficient that a known plate-shaped member moving method is used. Note that in the recording apparatus using the ejection head 12 according to the present invention, the recording medium P may be scanned by the nozzle rows by fixing the recording medium P and moving (scanning) the ejection head 12.

A terminal on one side of the counter bias voltage supply 62 is connected to the counter electrode 60, and the counter bias voltage supply 62 applies to the counter electrode 60 a bias voltage having a polarity opposite to that of the ejection electrodes 30 and the colorant particles. Note that a terminal on the other side of the counter bias voltage supply 62 is grounded.

Hereinafter, an image recording operation of the recording apparatus 10 will be described.

At the time of image recording, the ink Q is circulated by the ink circulation system 16 through the path from the ink supply unit 54 through the ink supply flow path 56, the ink flow path 32 of the ejection head 12, and the ink recovery flow path 58 to the ink supply unit 54 again. As a result of the circulation, the ink Q flows into the ink flow path 32 (ink flow of 200 mm/second, for instance) and is supplied to each ejection opening 24.

Also, at the time of the image recording, the bias voltage supply 52 applies a bias voltage of 100 V to the ejection electrodes 30. Further, the recording medium P is held by the counter electrode 60, and the counter bias voltage supply 62 applies a bias voltage of −1000 V to the counter electrode 60. Accordingly, between the ejection electrodes 30 and the counter electrode 60 (recording medium P), a bias voltage of 1100 V is applied, electric fields corresponding to the bias voltage are formed, and electrostatic forces are exerted.

As a result of the circulation of the ink Q, the electrostatic forces resulting from the bias voltage, the surface tension of the ink Q, the capillary phenomenon, the action of the ink guides 22, and the like, meniscuses of the ink Q are formed at the ejection openings 24. Then, the colorant particles (positively charged in this example) migrate to the ejection openings 24 (meniscuses), and the ink Q is concentrated. As a result of the concentration, the meniscuses further grow. Finally, a balance is obtained between the surface tension of the ink Q and the electrostatic forces or the like, and the meniscuses are placed in a stabilized state.

In this state, when the drive voltage supply 50 applies drive voltages of 200 V or the like to the ejection electrodes 30, the electrostatic forces acting on the ink Q and the meniscuses are increased, the concentration of the ink Q at the meniscuses is promoted, and the meniscuses sharply grow. Following this, when the attraction force from the counter electrode 60 exceed the surface tension of the ink Q, the ink Q, in which the colorant particles are concentrated, is ejected as the ink droplets R.

The ejected ink droplets R fly due to momentum at the time of the ejection and the electrostatic attractive force by the counter electrode 60, impinge on the recording medium P, and form an image.

As described above, at the time of the image recording, the recording medium P is scan-transported in the scanning direction orthogonal to the nozzle rows while facing the ejection head 12.

Accordingly, by performing modulation and applying a drive voltage to each ejection electrode 30 (driving the ejection electrode 30) in accordance with image data (ink droplet R ejection signal) in synchronization with the scan-transport, it becomes possible to perform modulation and eject the ink droplets R in accordance with an image to be recorded and perform image recording onto the entire surface of the recording medium P in an on-demand manner.

In the ejection head 12 shown in FIGS. 1A and 1B, the ejection electrodes 30 and the electrode lines 38 are connected to each other, but the present invention is not limited thereto and the shield electrode 26 may be connected to the electrode lines.

Figure 5A:
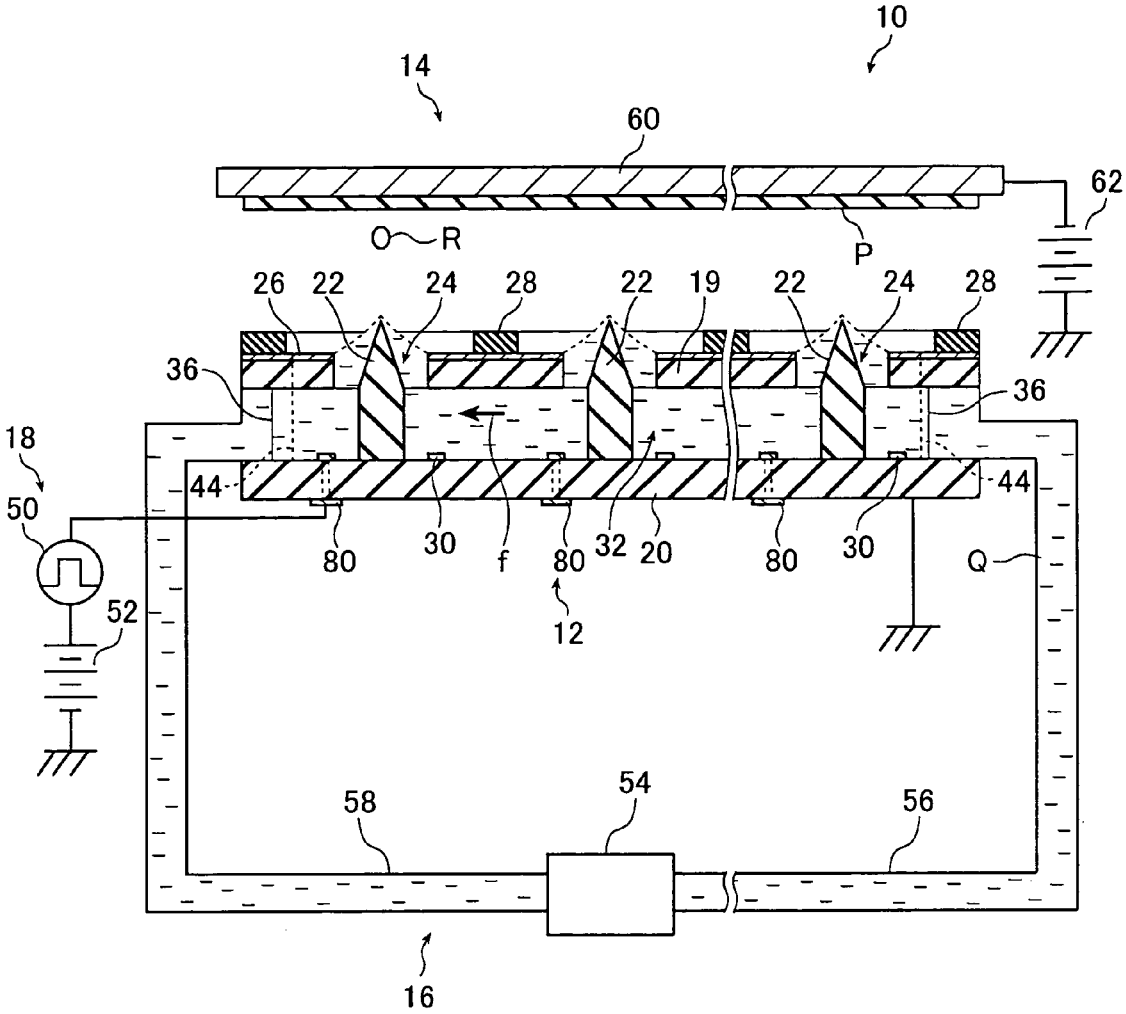
FIG. 5A is a conceptual diagram of another example of the liquid ejection head according to the present invention.
Figure 5B:
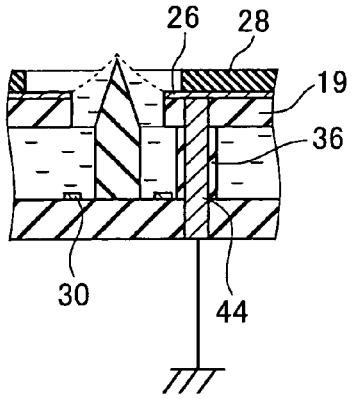
FIG. 5B is a partial diagram of the liquid ejection head shown in FIG. 5A.
Figure 6:
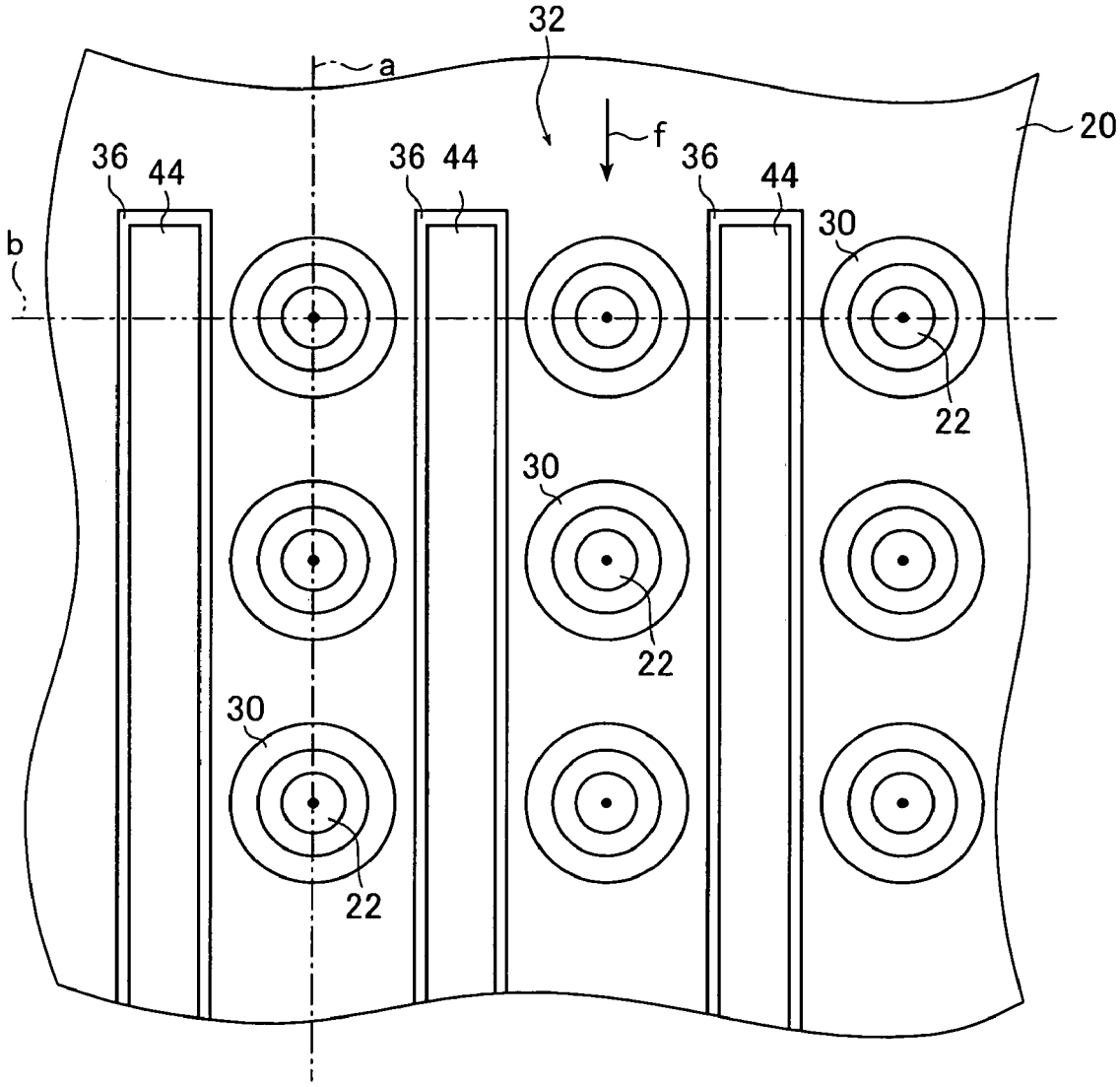
FIG. 6 is a conceptual top view of the liquid ejection head shown in FIGS. 5A and 5B.

An example of the construction is shown in FIGS. 5A and 5B and a top view thereof (top view in which the ejection substrate 19 is removed like in FIG. 3) is shown in FIG. 6. Note that FIG. 5A is a cross-sectional view taken along line a in FIG. 6, while FIG. 5B is a cross-sectional view taken along line b in FIG. 6 for clearer construction illustration.

In FIGS. 5A, 5B, and 6, except that the shield electrode 26 is connected to electrode lines 44 and the ejection electrodes 30 are formed on the upper surface of the support substrate 20 (bottom surface of the ink flow path 32), basically the same construction as the ejection head 12 described above is used, so each member is given the same reference numeral and each different point will be mainly described in the following explanation. Also, in a construction in which the ejection electrodes 30 are formed on the upper surface of the support substrate 20 like in the example shown in FIGS. 5A and 5B, it is preferable to form the shield electrode 26 also above the ejection electrodes 30.

In the ejection head shown in FIGS. 5A and 5B, the electrode lines 44 pass through the ejection substrate 19 and are connected to the shield electrode 26 formed on the upper surface of the ejection substrate 19. Also, some of the electrode lines 44 (electrode lines 44 in the vicinity of the right-side end portion in FIG. 5A) pass through the support substrate 20 and are grounded from the underside (see FIG. 5B).

Here, the shield electrode 26 is common to every ejection portion, so when the shield electrode 26 and the electrode lines are connected to each other, and when one flow path wall portion is formed for each group of multiple ejection portions, it is not required to establish the electrode line connection for each ejection portion. Accordingly, when one flow path wall portion 40 is formed for each row of ejection portions like in the illustrated example, it is preferable that an electrode line 44 corresponding to the whole row of the ejection portions be contained in the flow path wall portion and be connected to the shield electrode 26 (it does not matter whether the connection is established at one spot or multiple spots). The construction, in which one electrode line 44 is provided for the entire region in the arrangement direction of each row of ejection portions, is advantageous in terms of suppressing electric field interferences between the respective ejection portions.

Also, in this example, the ejection electrodes 30 are not formed on a lower-surface side of the ejection substrate 19 but are formed on an upper-surface (ink-flow-path-32-bottom-surface) side of the support substrate 20.

With the line construction described above in which the shield electrode 26 and the electrode lines 44 contained in the flow path wall portions 36 are connected to each other, the same state as in the case where the shield electrode is arranged in the ink flow path 32 is obtained, so it becomes possible to more suitably prevent the electric field interferences between the respective ejection portions (inter-channel electric field interferences) and eject the ink droplets R with stability.

Also, in this form, as a preferable form, by providing the ejection electrodes 30 for the upper surface of the support substrate 20, extraction of wiring from the underside is made possible, and complication of the wiring at the time of high-density arrangement or two-dimensional arrangement of the ejection portions is prevented.

Even in the construction described above in which the shield electrode 26 is connected to the electrode lines that the flow path wall portions contain, one flow path wall portion may be formed for each ejection portion as shown in FIG. 4 and may contain an electrode line connected to the shield electrode 26. Alternatively, one group of multiple flow path wall portions extending in the ink flow direction may be provided for each row of multiple ejection portions. Alternatively, flow path wall portions that are respectively common to appropriately set groups of multiple ejection portions may be formed and may contain the electrode lines connected to the shield electrode.

Figure 7:
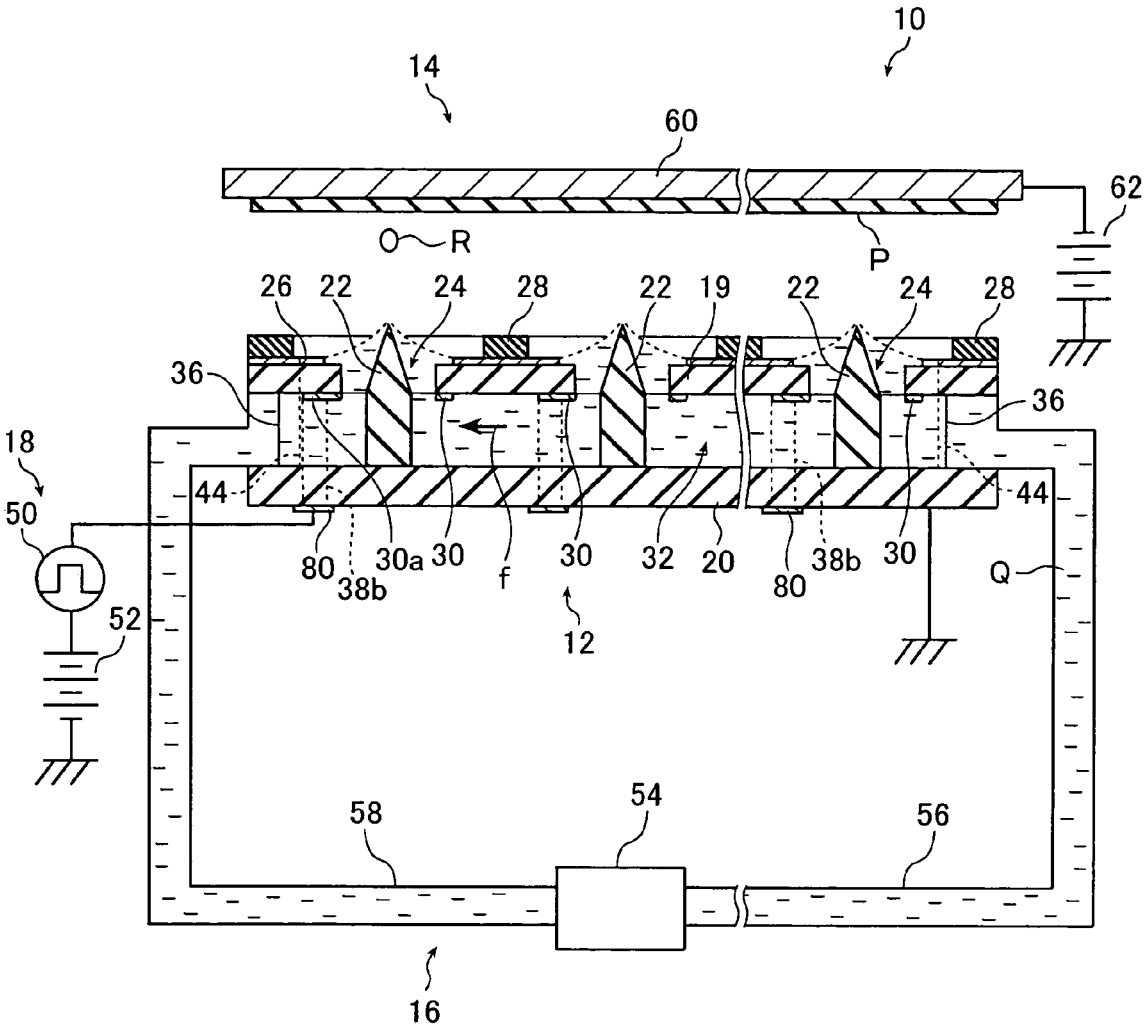
FIG. 7 is a conceptual diagram of another example of the liquid ejection head according to the present invention.

Further, the ejection head according to the present invention is not limited to the construction, in which only the ejection electrodes are connected to the electrode lines contained in the flow path wall portions, and the construction in which only the shield electrode is connected to the electrode lines. For instance, as shown in a conceptual diagram in FIG. 7 and a top view in FIG. 8 (top view in which the ejection substrate 19 is removed like in FIG. 3), the electrode lines 38 for the ejection electrodes 30 and the electrode lines 44 for the shield electrode 26 may be contained in the flow path wall portions 36 and both of the electrodes may be connected to corresponding electrode lines (see FIG. 1B described above for the electrode lines 38 and see FIG. 5B described above for the electrode lines 44).

With the construction, it becomes possible to attain both the ease of the wiring to the ejection electrodes 30 resulting from the connection to the voltage application units 18 from the underside of the support substrate 20 and the effect of suppressing the electric field interferences between the ejection portions due to the existence of the electrode lines 44 connected to the shield electrode 26 in the ink flow path.

It should be noted here that even in the construction described above in which both the electrode lines corresponding to the ejection electrodes 30 and the electrode lines corresponding to the shield electrode 26 are contained in the flow path wall portions, one flow path wall portion 36 may be formed for each ejection portion as shown in FIG. 4. Alternatively, groups of multiple flow path wall portions extending in the ink flow direction may be provided so that they respectively correspond to rows of multiple ejection portions. Alternatively, flow path wall portions that are each common to multiple ejection portions may be formed. Alternatively, flow path wall portions 40 that are respectively common to rows of ejection portions in the ink flow direction (direction of arrow f) may be provided as shown in FIG. 8.

Figure 8:
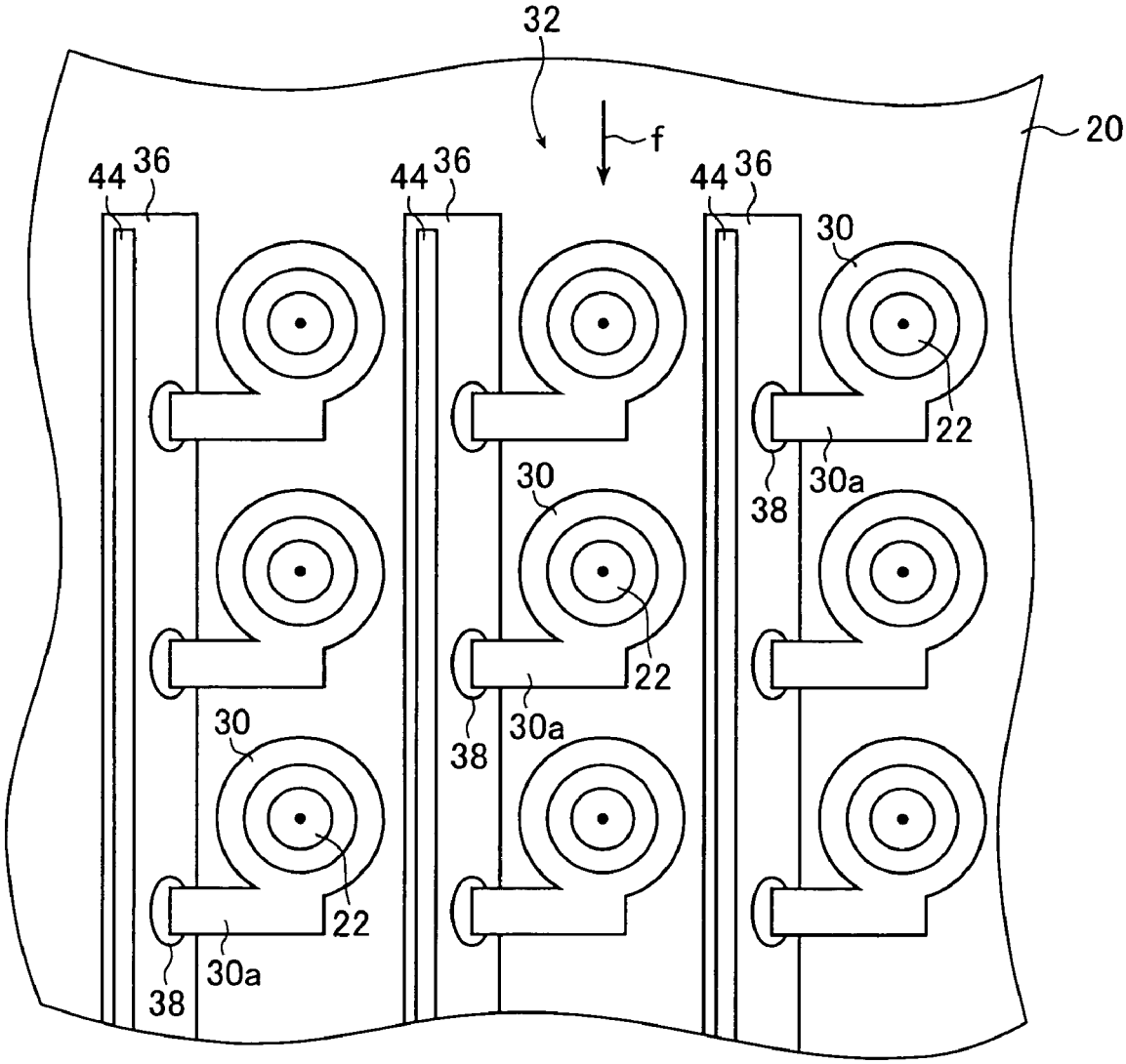
FIG. 8 is a conceptual top view of the liquid ejection head shown in FIG. 7.

Also, it is required to provide one electrode line 38*a* for each ejection electrode 30 but the shield electrode 26 is common to every ejection portion as described above, therefore like in the example described above, from the viewpoint of the electric field interference suppression, it is preferable that the electrode lines 44 be provided so that they each correspond commonly to the whole row of ejection portions as shown in FIG. 8.

It should be noted here that the electrode lines connected to the shield electrode 26 are not required to pass through the flow path wall portions 36 and may end midway through the flow path wall portions. Accordingly, when only the shield electrode is connected to the electrode lines, it is not required that the flow path wall portions 36 be joined to the ejection substrate 19 and the support substrate 20, and a construction may be used in which the flow path wall portions droop down from the ejection substrate 19 into the ink flow path 32.

Also, in the illustrated example, the electrode lines both are connected to the outside from the underside of the support substrate 20, but the present invention is not limited thereto and the electrode lines may be connected to the outside from a side surface (side edge portion) of the support substrate 20 through wiring in the support substrate 20.

It is possible to produce such an ejection head according to the present invention using a semiconductor manufacturing technique or the like.

In FIGS. 9A to 9K, an example of the ejection head manufacturing method according to the present invention is conceptually shown. Note that the example shown in FIGS. 9A to 9K (and an example shown in FIGS. 10A to 10L to be described later) is an example in which the manufacturing method according to the present invention is applied to manufacturing of the ejection head 10 shown in FIG. 1A and the like, but it is also possible to manufacture the ejection heads in the other forms, whose examples are shown in FIGS. 4 to 8, according to the method.

Figure 9A:
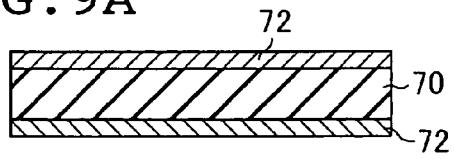
FIGS. 9A to 9K are conceptual diagrams for explanation of a method of manufacturing the liquid ejection head shown in FIGS. 1A and 1B.

First, as shown in FIG. 9A, a metallic layer 72 is formed for both sides of an insulating substrate 70. Note that as the insulating substrate, a substrate made of an organic material like polyimide, a substrate made of glass, or a substrate made of an inorganic material like alumina or zirconia is used.

Figure 9B:
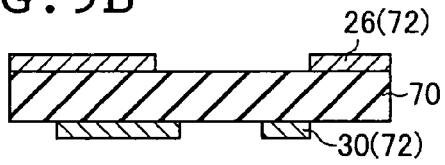
Figure 9C:
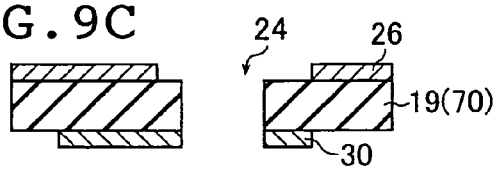

Next, as shown in FIG. 9B, predetermined regions of the metallic layer 72 are removed, and the shield electrode 26 and the ejection electrode 30 are formed through pattern formation. Then, as shown in FIG. 9C, a through hole, that is, the ejection opening 24 is formed at a predetermined position of the insulating substrate 70. As a result, the ejection substrate 19 is obtained. Note that it is sufficient that the removal of the metallic layer 72 and the boring of the insulating substrate 70 are performed with a known method such as laser beam machining or etching.

Figure 9D:
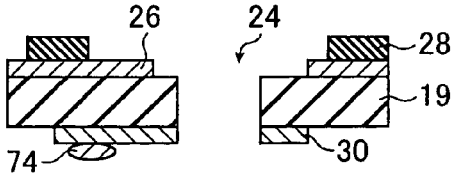

Further, as shown in FIG. 9D, a layer of an insulating material, such as polyimide, is formed for a surface of the ejection substrate 19, the vertical barrier 28 is formed through machining of the insulating material layer by laser beam machining, etching, or the like, and a bump (connection member) 74 is formed using solder, gold, or the like at a predetermined position of the ejection electrode 30.

Figure 9E:
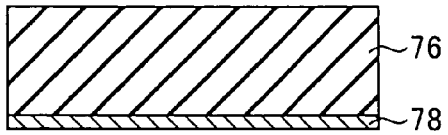

On the other hand, as shown in FIG. 9E, a metallic layer 78 is formed for a surface of another insulating substrate 76. It is sufficient that the insulating substrate 76 is made of material the same as the insulating substrate 70 described above.

Figure 9F:
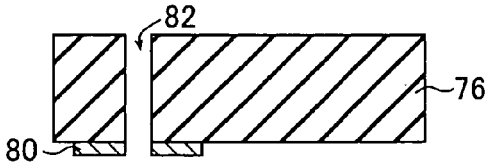
Figure 9G:
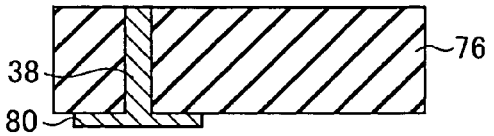

Next, as shown in FIG. 9F, predetermined regions of the metallic layer 78 are removed and a connection portion (connection terminal) 80 with the voltage application unit 18 is formed through pattern formation and a through hole 82 is formed in a predetermined portion of the insulating substrate 76. Then, as shown in FIG. 9G, the electrode line 38 is formed by filling the through hole 82 with coating metal or the like.

Figure 9H:
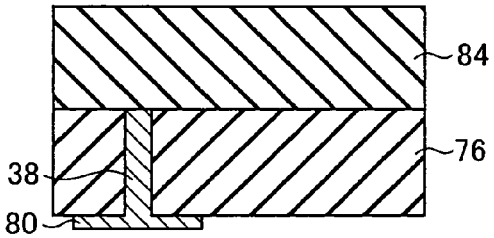
Figure 9I:
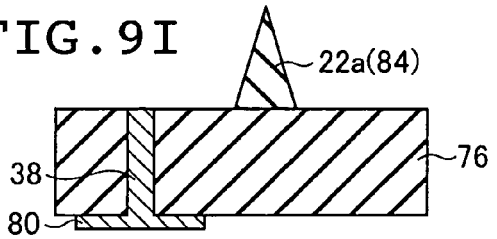

Following this, as shown in FIG. 9H, an insulating material layer 84 is formed on a surface (upper surface in FIG. 9H) of the insulating substrate 76 in the same manner as above. Then, as shown in FIG. 9I, the needle-shaped tip end portion 22*a* of the ink guide 22 is formed by removing (machining) predetermined sites of the insulating material layer 84 and a region of the insulating material layer 84 corresponding to the electrode line 38 is removed.

Figure 9K:
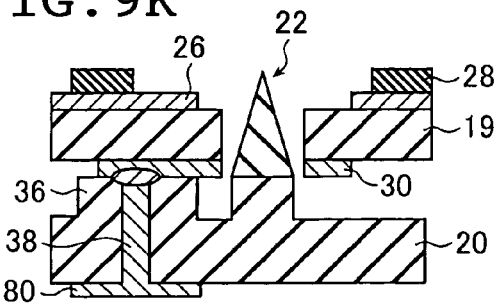
Figure 9J:
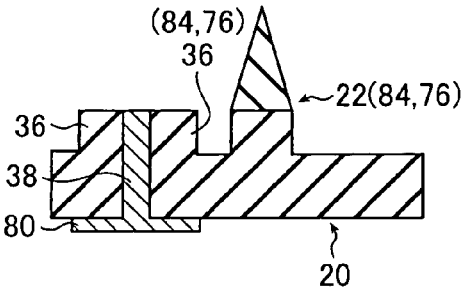

Further, as shown in FIG. 9J, predetermined regions of the insulating substrate 76 are removed, thereby forming the ink guide 22 and the flow path wall portion 36. As a result, the support substrate 20 is obtained.

It should be noted here that it is sufficient that the machining described above is performed with a known method, such as laser beam machining or etching, like in the case described above.

After the ejection substrate 19 (FIG. 9D) and the support substrate 20 (FIG. 9J) are formed in the manner described above, the bump 74 formed for the ejection electrode 30 and the top end of the electrode line 38 are aligned with each other. Then, the ejection electrode 30 and the electrode line 38 are fastened to each other by dissolving the bump 74 through heating at around 300° C. Alternatively, other predetermined joining portions are also fixed to each other. As a result, an assembly as shown in FIG. 9K is obtained as the ejection head 12.

In the example shown in FIGS. 9A to 9K, the ejection head is produced by forming the flow path wall portion 36 on a support substrate 20 side and joining the substrates to each other, but the present invention is not limited thereto and the ejection head may be produced by forming the flow path wall portion 36 on an ejection substrate 19 and joining the substrates to each other.

In FIGS. 10A to 10L, an example of such a case is conceptually shown. Here, it is sufficient that various kinds of machining in this example are performed with a known method, such as laser beam machining or etching, like in the example described above. Also, it is sufficient that the same materials as in the example described above are used.

Figure 10A:
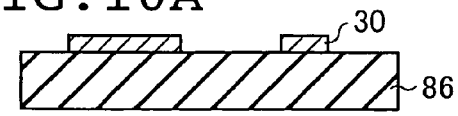
FIGS. 10A to 10L are conceptual diagrams for explanation of another example of the method of manufacturing the liquid ejection head shown in FIGS. 1A and 1B.
Figure 10B:
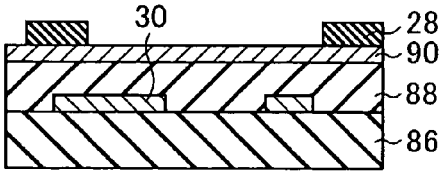
Figure 10C:
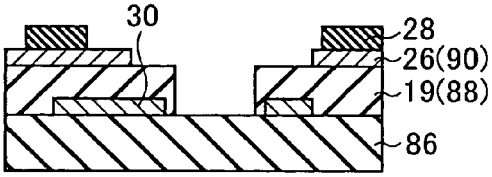

First, as shown in FIG. 10A, after a metallic layer is formed on an insulating material layer 86, predetermined regions of the metallic layer are removed, and the ejection electrode 30 is formed through pattern formation. Next, as shown in FIG. 10B, a substrate layer 88 is formed on the insulating material layer, a metallic layer 90 is formed on the substrate layer 88, and the vertical barrier 28 is formed on the metallic layer 90 in the same manner as in the example described above. Further, as shown in FIG. 10C, predetermined portions of the metallic layer 90 and the substrate layer 88 are etched and patterned, thereby forming the ejection substrate 19 and the shield electrode 26.

Figure 10D:
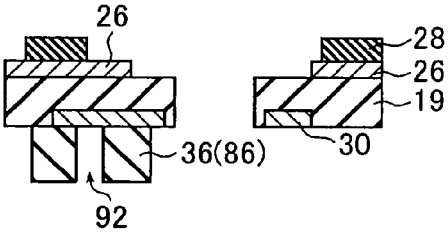
Figure 10E:
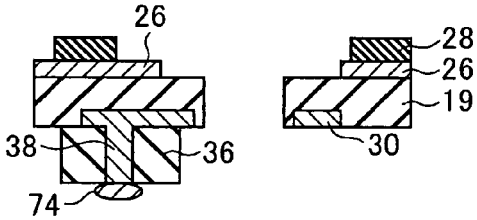

Next, as shown in FIG. 10D, the flow path wall portion 36 having a through hole 92 for an electrode line is formed by removing predetermined regions of the insulating material layer 86. Further, as shown in FIG. 10E, the electrode line 38 is formed by filling the through hole 92 with a metal, and a bump 74 that is the same as the bump in the example described above is formed in the lower end portion of the electrode line 38.

Figure 10L:
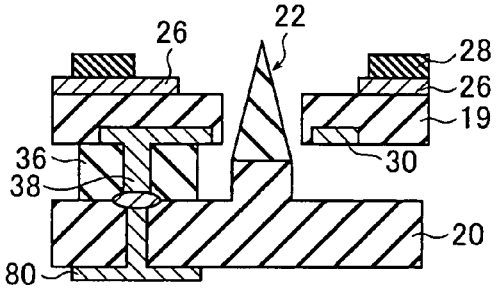
Figure 10F:
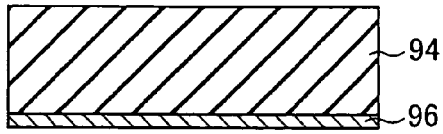
Figure 10G:
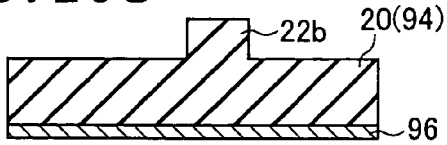

On the other hand, as shown in FIG. 10F, a metallic layer 96 is formed on one surface of an insulating substrate 94. Then, as shown in FIG. 10G, the support substrate 20 having the base portion 22*b* of the ink guide 22 is obtained by removing predetermined regions of the insulating substrate 94.

Figure 10H:
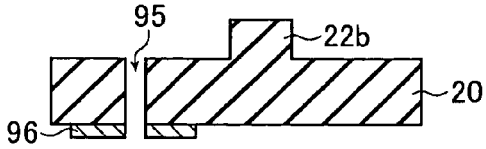
Figure 10I:
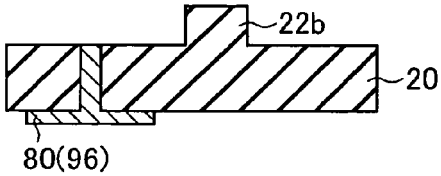

Next, as shown in FIG. 10H, predetermined regions of the metallic layer 96 are removed, and a through hole 95 is formed by boring a predetermined portion of the support substrate 20. Then, as shown in FIG. 10I, the connection portion (connection terminal) 80 for connection to the voltage application unit 18 is formed by filling the through hole 95 with a metallic material.

Figure 10J:
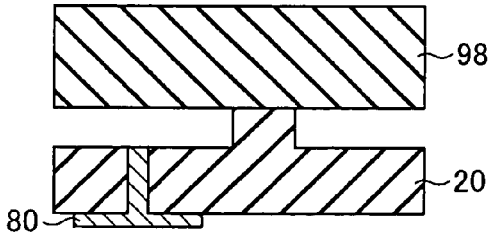
Figure 10K:
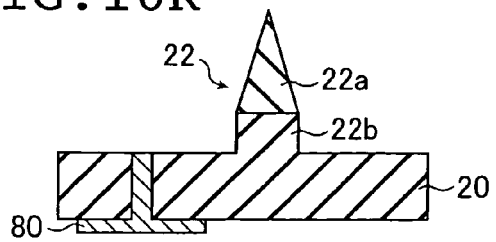

Further, as shown in FIG. 10J, an insulating material layer 98 is formed above the base portion 22*b* of the ink guide 22. Then, as shown in FIG. 10K, the tip end portion 22*a* of the ink guide is obtained by removing/machining unnecessary regions of the insulating material layer 98. As a result, the support substrate 20, on which the ink guide 22 is formed, is obtained.

After the ejection substrate 19 (FIG. 10E) and the support substrate 20 (FIG. 10K) are formed in the manner described above, the bump 74 formed for the electrode line 38 and the top end of the connection portion (connection terminal) 80 for connection to the voltage supply unit 18 are aligned with each other. Then, like in the example described above, the connection portion (connection terminal) 80 and the electrode line 38 are fastened to each other by dissolving the bump 74 through heating at around 300° C. Alternatively, other predetermined joining portions are also fixed to each other. As a result, an assembly shown in FIG. 10L is obtained as the ejection head 12.

In the manufacturing method according to the present invention described above, it is sufficient that the alignment of the ejection substrate 19 and the support substrate 20 (bump 74 and electrode line 38) with each other is performed using a flip chip bonder or the like. At this time, the accuracy of the alignment of the ejection substrate 19 and the support substrate 20 with each other is determined by the size of the bump 74 and the width of the electrode line 38, so it becomes possible to perform the alignment in an almost self-alignment manner. That is, it becomes possible to manufacture the ejection head according to the present invention having the superior characteristics described above through simple processes, with superior productivity, at low cost, and with high accuracy.

Also, as described above, it is possible to extend the electrode lines 38 connected to the ejection electrodes 30 to the underside of the support substrate 20, so it becomes possible to prevent complication of wiring resulting from two-dimensional arrangement or an increase in resolution. Further, the flow path wall portions 36 are provided, so it becomes possible to prevent the occurrence of warpage of the ejection substrate 19 and the support substrate 20 and the like.

The liquid ejection head and the liquid ejection head manufacturing method according to the present invention have been described in detail above, but the present invention is not limited to the embodiment described above, and it is of course possible to make various changes and modifications without departing from the gist of the present invention.

What is claimed is:

1. A liquid ejection head for ejecting droplets of a solution, in which charged particles are dispersed, by exerting electrostatic forces on the solution, comprising:

an insulating ejection substrate in which through holes are bored to form ejection openings for ejecting the droplets;

an insulating support substrate arranged while facing said ejection substrate with a predetermined distance therebetween;

a solution flow path formed by said ejection substrate, said support substrate and first and second insulating flow path sidewalls provided between said ejection substrate and said support substrate;

ejection electrodes provided on the insulating ejection substrate, respectively around the through holes, for exerting the electrostatic forces on the solution; and a shield electrode provided on the insulating ejection substrate, corresponding to at least one of the through holes on a solution ejection side with respect to said ejection electrodes, for preventing electric field interferences between the through holes, wherein insulating flow path wall portions, each of which is joined to said ejection substrate and said support substrate and is different from the first and second flow path sidewalls, are formed in a central part of said solution flow path at the positions of the through holes, and are located within said flow path so that all sidewalls of each of said flow path wall portions are in contact with the solution flowing through the inside of said solution flow path, and at least one of electrode lines connected to said ejection electrodes and electrode lines connected to said shield electrode are included in the inside of the flow path wall portions.

2. The liquid ejection head according to claim 1, wherein solution guides are provided while standing from said support substrate, respectively corresponding to the through holes and protruding to a droplet ejection side of said ejection substrate by passing through the through holes are provided while standing from said support substrate.

3. The liquid ejection head according to claim 1, wherein:

said ejection electrodes are formed on a substrate surface on a solution flow path side of said ejection substrate; and said ejection electrodes are connected to the electrode lines, the electrode lines passing through said support substrate via the flow path wall portions and extending to an underside of said support substrate on a side opposite to said solution flow path, on which side connection terminals for connection to external voltage supply units are provided, or the electrode lines extending from said support substrate to a side surface of said support substrate via the flow path wall portions and being connected to external voltage supply units from the side surface.

4. The liquid ejection head according to claim 1, wherein said shield electrode is provided to a substrate surface on a side opposite to said solution flow path of said ejection substrate, and said ejection electrodes are provided to a substrate surface on a side facing said solution flow path of said ejection substrate.

5. The liquid ejection head according to claim 1, wherein the through holes form rows along a solution flow direction in said solution flow path, one flow path wall portion is formed for a group of the through holes along each of the rows of the through holes, and the electrode lines corresponding to the through holes in the group are contained in each of the flow path wall portions.

6. The liquid ejection head according to claim 1, wherein a surface of said shield electrode is given ink repellency.

7. The liquid ejection head according to claim 1, wherein said shield electrode is formed of a conductor layer on said ejection substrate to surround peripheries of ejection openings of the through holes, and vertical barriers that separate meniscuses of the solution formed in the vicinity of the ejection openings from each other are provided to an upper surface of the conductor layer forming said shield electrode.

8. The liquid ejection head according to claim 1, wherein the through holes form rows along a solution flow direction in said solution flow path, one flow path wall portion is formed for one row of the through holes along each of the rows of the through holes, and the electrode lines corresponding to the rows of the through holes are contained in each of the flow path wall portions.

9. The liquid ejection head according to claim 1, wherein one flow path wall portion is formed for one through hole, and an electrode line corresponding to each of the through holes is contained in each of the flow path wall portions.

10. The liquid ejection head according to claim 1, wherein the centrally located insulating flow path wall portions connecting the ejection substrate to the support substrate are arranged inside the solution flow path away from the first and second flow path sidewalls which define the solution flow path together with the ejection substrate and the support substrate.

11. A liquid ejection head for ejecting droplets of a solution, in which charged particles are dispersed, by exerting electrostatic forces on the solution, comprising:

an insulating ejection substrate in which through holes are bored to form ejection openings for ejecting the droplets;

an insulating support substrate arranged while facing said ejection substrate with a predetermined distance therebetween;

a solution flow path provided between said ejection substrate and said support substrate;

ejection electrodes provided on the insulating ejection substrate, respectively around the through holes, for exerting the electrostatic forces on the solution; and a shield electrode provided on the insulating ejection substrate, corresponding to at least one of the through holes on a solution ejection side with respect to said ejection electrodes, for preventing electric field interferences between the through holes, wherein insulating flow path wall portions being joined to said ejection substrate and said support substrate are formed in said solution flow path at the positions of the through holes, and at least one of electrode lines connected to said ejection electrodes and electrode lines connected to said shield electrode are contained in the flow path wall portions, wherein said shield electrode is formed on a substrate surface on a side opposite to said solution flow path of said ejection substrate, the flow path wall portions contain the electrode lines connected to said ejection electrodes and the electrode lines connected to said shield electrode, and the electrode lines connected to said shield electrode pass through said ejection substrate and extend to a substrate surface side of said ejection substrate on which said shield electrode is formed.

* * * * *